United States Patent [19]

Gardner et al.

[11] 4,097,315

[45] Jun. 27, 1978

[54] MAGNETIC ORIENTATION OF CASTING POWDER GRANULES

[75] Inventors: William H. Gardner, Lavale, Md.; Donald H. Graham, Fort Ashby, W. Va.; George M. Williams, Cumberland, Md.

[73] Assignee: Hercules Incorporated, Wilmington, Del.

[21] Appl. No.: 715,131

[22] Filed: Mar. 21, 1968

[51] Int. Cl.[2] ..... C06B 45/00

[52] U.S. Cl. ..... 149/2; 149/92; 149/98; 149/100; 149/76; 264/3 R; 264/3 B; 264/3 C

[58] Field of Search ..... 149/2, 19, 109; 264/3; 102/102; 252/62.55

[56] References Cited

U.S. PATENT DOCUMENTS

| | | | |
|---|---|---|---|
| 3,267,858 | 8/1966 | Nix et al. | 102/102 |
| 3,359,350 | 12/1967 | Godfrey | 264/3 |
| 3,389,025 | 6/1968 | Nix et al. | 149/19 |

*Primary Examiner*—Stephen J. Lechert, Jr.
*Attorney, Agent, or Firm*—Michael B. Keehan

[57] ABSTRACT

A casting powder granule containing a magnetic material is provided. The granule can be oriented in a desired direction by an applied magnetic field. Cast propellant charges having augmented burning rates can be prepared from magnetically susceptible casting powder granules containing metallic staple which are oriented by a magnetic field prior to addition of casting solvent.

11 Claims, No Drawings

MAGNETIC ORIENTATION OF CASTING POWDER GRANULES

This invention relates to a casting powder granule which is susceptible to orientation in a given direction by a magnetic force. More particularly, this invention relates to a method of augmenting the burning rate of a cast propellant charge by orienting casting powder granules.

Metallic staple, that is, thin fragments of metal wire or metal strips, can be incorporated into casting powder by addition of metallic staple to a casting powder matrix during mixing. The metallic staple increases propellant burning rates and is a source of energy in the propellant. Metallic staple can be prepared from tantalum, aluminum, titanium, magnesium, molybdenum, zirconium, hafnium, silver, copper, niobium, tungsten, or alloys of these metals. During extrusion of the powder matrix to form casting powder granules, the metallic staple aligns itself parallel to the longitudinal axis of the casting powder strand being extruded.

It is known that maximum burning rate augmentation of propellants containing metallic staple is achieved when the longitudinal axis of the staple is normal or perpendicular to the burning front of the propellant. Orientation of metallic staple incorporated into propellant made by slurry casting has been achieved by forcing the slurry through a barrier having a multiplicity of uniform passageways. The metallic staple is physically oriented when the slurry is forced through barrier passageways in the desired direction. A report containing additional pertinent information on this subject is entitled, "Orientation of Staple in Fast Burning Propellants (U)" by Picatinny Arsenal, Technical Report 3303, of January 1966.

Heretofore, no method has been available to align casting powder granules. It is well known that propellant charges prepared by conventional casting of casting powder granules and a casting solvent have superior mechanical properties to propellants prepared by slurry casting. Furthermore, ballistic reproducibility of conventionally cast propellant charges is excellent, and readily controllable. The present invention provides the advantages inherent with conventionally cast propellant charges as well as providing a method to orient casting powder granules which can contain metallic staple. While this invention is particularly directed to orientation of casting powder granules that do contain metallic staple in order to achieve augmented burning rates, it is clear that it is not so limited. An additional advantage of this invention is that higher loading densities can be achieved by orienting casting powder granules in a mold than can be obtained by random loading of a mold.

Accordingly, it is an object of this invention to provide a casting powder granule which is susceptible to orientation by a magnetic force.

It is another object of this invention to provide a casting powder granule containing metallic staple which can be aligned so that the axis of the granule and staple are parallel, and normal to the burning front of the propellant.

It is another object of this invention to provide a method for increasing the loading density of casting powder granules.

It is still another object of this invention to provide cast propellant charge prepared from casting powder granules containing metallic staple wherein the axis of the staple is essentially normal to the burning front of the cast propellant whereby the propellant burning rate is augmented.

Other objects of this invention will, in part, be obvious and will in part appear hereinafter. For a complete understanding of the nature and objects of this invention, reference is made to the following detailed description.

In accordance with this invention there is provided a casting powder granule having incorporated therein a magnetic material having a magnetic susceptibility. The magnetic material is employed in an amount sufficient to respond to an applied magnetic field. The magnetic field causes a torque or twisting force in each casting powder granule resulting in the alignment of the magnetically susceptible material with the lines of flux generated by the magnetic field. The orientation of the casting powder is therefore controlled by the direction of the lines of flux of the applied magnetic field.

In order to describe the magnetic properties of magnetic materials as the term is used herein, and in particular to describe magnetic susceptibility, a quantitative measure of magnetization is required. Such a measure is the magnetic moment per unit volume I. This term can be defined in relation to magnetic induction B, and the strength of a magnetic field H. The strength of a magnetic field H, in a vacuum, is defined as one Oersted when the mechanical force of one dyne in the direction of the magnetic field is experienced by a unit magnetic pole placed in that field. The equation relating these terms is:

$$B = H + 4\pi I$$

where B is magnetic induction or flux density (Gauss). Based on this fundamental equation, important characteristics of magnetic materials are defined. One of these is the ratio of B/H which is defined as permeability, $\mu$. Permeability is the relative increase in flux caused by the presence of a magnetic material in a magnetic field.

The susceptibility of a magnetic material K, is defined as the increase in magnetic moment I, caused by application of a magnetic field H. Susceptibility K can be defined as the ratio I/H, or in terms of permeability as the ratio $(\mu - 1)/4\pi$.

By definition, a magnetic material has a magnetic susceptibility, i.e., the permeability is not one. A magnetic material can be classified as ferromagnetic, ferrimagnetic, diamagnetic, antiferromagnetic and paramagnetic.

Magnetic materials as defined herein can be incorporated into the casting powder granules of this invention. It is generally preferred that the magnetic materials have a magnetic susceptibility of at least about $0.1/4\pi$ or a permeability of greater than about 1.1. Magnetic materials having a magnetic susceptibility of at least about $0.1/4\pi$ can be referred to as ferromagnetic.

Illustrative ferromagnetic materials having a magnetic susceptibility of about $0.1/4\pi$ or greater which can be employed include iron, cobalt, nickel, and their alloys, and the rare earth metals, such as gadolinium, terbium, dysprosium, halmium, erbium and their alloys.

Other important magnetic materials which can be employed are of the ferrite type and have a magnetic susceptibility of about $0.1/4\pi$ or greater. Illustrative of ferrite type magnetic materials which can be employed are materials having the general formula ($MO \cdot Fe_2O_3$)

wherein M is one of or a mixture of divalent cations selected from the group consisting of manganese, cobalt, nickel, copper, magnesium, cadmium, and the ferrous cation $Fe_2+$. Other illustrative ferrites which can be employed have the general formula $M_3Fe_5O_{12}$ wherein M is a trivalent cation such as manganese or copper.

Magnetic material can be incorporated into the casting powder granule in the form of wire, in the form of powder generally having a particle size ranging from submicron to about 500 microns, or in the form of magnetic staple. The amount of magnetic material incorporated in a casting powder granule to permit orientation of the granule will vary, depending on the strength of the magnetic field to be applied. The concentration of magnetically susceptible material required for orientation purposes decreases as the magnetic field strength increases. A practical limit as to the amount of magnetically susceptible material to be incorporated in a granule can be determined by experimentation of one skilled in the art based on the strength of the magnetic field that can be applied, size of the grain to be cast, and determination of the loss of ballistic performance in the resulting cast propellant charge due to the presence of the magnetic ingredient. In general, the amount of magnetic material will vary from about 0.1 to about 10% by weight based on the weight of the casting powder granules.

It is generally desirable to orient the casting powder granules, with or without metallic staple contained therein, either parallel or perpendicular to the longitudinal axis of the resulting cast propellant charge. To obtain maximum burning rate augmentation, the primary effect desired from orientation of granules containing metallic staple, the longitudinal axis of the granule must be substantially normal or perpendicular to the burning front of the cast propellant charge.

In the examples that will follow, two test apparatus were constructed and employed in evaluating the feasibility of magnetically orienting casting powder. These test apparatus are described below.

RADIAL ORIENTATION TEST APPARATUS

A solenoid coil containing approximately 500 feet of single strand 14 BWG copper conductor insulated wire having a resistance of 1.6 ohms is wrapped around one end of a 1¾ inch mild steel iron rod, 25 inches long. About 600 coils are wrapped on a 10-inch section. The wire leads are equipped for attachment to a wet cell automotive type 12-volt battery. A transparent cellulose acetate beaker is seated over the solenoid coil induction rod assembly. The beaker has an outside diameter of 4.8 inches, an inside diameter of 4.5 inches, is 20 inches long, and has a hollow center tube with a 2¼ inch outside diameter and a 2-inch inside diameter, to house the solenoid coil induction rod assembly. A vibrator is vertically mounted to the outside of the assembly and is operated during loading and orientation of the casting powder granules.

VERTICAL ORIENTATION TEST APPARATUS

About 600 turns of 14 BWG copper wire having a resistance of about 2.5 ohms is wrapped on the outside of 3-inch diameter by 10 inch long cellulose acetate insulator tube. The circuit is energized with two 12-volt direct current batteries connected in series. A tube in which the casting powder is tested for orientation is inserted inside the solenoid winding. This tube is open at one end, has an inside diameter of about 2½ inches and is made of cellulose acetate. A vibrator is attached to this tube.

The following examples further illustrate this invention. All parts and percentages are by weight unless otherwise specified. The formulations of the casting powders employed in these examples are given in Table I.

Table I

| Ingredient | Casting Powder Formulations A | B | C | D | E | F |
|---|---|---|---|---|---|---|
| Nitrocellulose | 39.2 | 27.5 | 40.0 | 40.0 | 27.5 | 27.5 |
| Triphenyl Phosphate | | | 16.5 | 16.5 | | |
| Tricresyl Phosphate | 7.2 | | | | | |
| Calcium Phosphate | 9.0 | | | | | |
| Aluminum Staple (.45 × 8.0 × 125 mil) | 7.2 | | | | | |
| (.4 × 4.5 × 125 mil) | | 8.0 | 8.0 | 7.5 | 7.0 | 9.0 |
| Aluminum Powder | 1.7 | | 2.0 | 2.0 | | |
| 2-nitro-diphenylamine | 0.9 | 1.0 | 1.0 | 1.0 | 1.0 | 1.0 |
| Potassium Sulfate | 28.1 | | 30.0 | 30.0 | | |
| Triacetin | 6.7 | | | | | |
| Nitroglycerin | | 10.0 | | | 10.0 | 10.0 |
| Ammonium Perchlorate | | 50.0 | | | 50.0 | 50.0 |
| Resorcinol | | 1.5 | | | 1.5 | 1.5 |
| Nickel Wire | 3.0 | | | | | |
| Nickel Staple (.45 × 4.0 × 125 mil) | | 2.0 | | | | |
| Nickel Powder | | | 2.5 | 3.0 | 3.0 | |
| Cobalt Powder | | 1.5 | | | | 1.0 |

EXAMPLE 1

A casting powder containing 7.2% of aluminum staple is mixed in a horizontal sigma blade mixer. The overall casting powder formulation is given in Table I, as composition A. The resulting casting powder dough is extruded through a one-hole die producing a nominal 0.145-inch diameter casting powder strand. The one-hole die is similar to a wire coating die. A nickel wire is centered in the die. The nickel wire is picked up continuously, and automatically pulled through the die by the extruding casting powder. The propellant strands having the nickel wire embedded therein are dried for 4 to 6 hours at ambient temperature. These temperature conditioned strands are then cut to produce a casting powder granule 145 mils long. The weight percent of nickel wire per granule is approximately 3%.

The casting powder granules prepared as described are tested for orientability by first being fed by gravity into the radial orientation test apparatus with the circuit and vibrator energized. The granules align in an excellent radial pattern for the entire length of the solenoid rod.

This experiment is repeated employing a cellulose acetate beaker having a nominal outside diameter of 13 inches and providing an annular web of about 5½ inches. Two 12-volt direct current batteries are connected in series to energize the coil. Excellent radial orientation is achieved.

The following example illustrates preparation of casting powder containing ferromagnetic staple (nickel) and radial and vertical orientation of this casting powder.

EXAMPLE 2

A casting powder mixture containing 8% aluminum staple is mixed employing conventional mixing methods and equipment. The overall powder formulation is given in Table I as composition B. About 2% nickel staple is incorporated into this mix.

The casting powder is extruded into strands having a 0.1 inch outside a diameter, is conditioned at 30°–40° C. for 1 hour, and is cut into granules of 111 mils in length. The casting powder granules are then loaded into the radial orientation test apparatus, heretofore described, with the circuit energized. Radial orientation is excellent.

Vertical orientation of these casting powder granules is attempted in the vertical orientation test apparatus heretofore described. Vertical orientation is not achieved due to insufficient strength of the magnetic field that can be applied by the test apparatus.

The following example illustrates incorporation of nickel powder into the casting powder, and orientation of the resulting casting powder granules.

EXAMPLE 3

A casting powder mixture is prepared employing conventional mixing procedures and equipment. About 2.5% of nickel powder having a nominal particle size ranging from about 1 micron to about 75 microns is added to the matrix. The overall powder formulation is given in Table I as composition C. The casting powder mixture is extruded into nominal 100-mil diameter strands and cut into granule lengths of 88 and 166 mils. Granules of both lengths are successfully oriented radially in the test apparatus heretofore described. Only marginal vertical orientation is achieved.

A second casting powder mixture is prepared with the nickel powder concentration increased to 3.0%. The overall mixture formulation is given in Table I, composition D. This mixture is extruded and cut to form a nominal 90-mil diameter casting powder granule. Excellent vertical and radial orientation are achieved with these granules.

The following example illustrates burning rate augmentation of cast propellant employing casting powder granules containing aluminum staple which are aligned normal to the burning front of the propellant.

EXAMPLE 4

A casting powder mixture, formulation E, Table I, is prepared employing conventional mixing procedures and equipment. The granules are oriented vertically in 2-inch diameter tubes.

These tubes are evacuated for 16 hours and vacuum cast with 75% nitroglycerin. The cast propellant charges produced are given 8 days ambient cure and 12 days heated (120° F.) cure. The charges are sawed to prepare burning strand sections, coated with a polyvinyl chloride inhibitor and fired. The burning rate increase for the strands containing oriented granules as compared to strands prepared from randomly oriented granules of the same formulation is about 60%. A comparison of strand burning rates for the oriented and non-oriented propellant is shown in Table II below.

Table II

| | Cast Propellant Strand Burning Rate (inches/second) | | | | |
|---|---|---|---|---|---|
| | | Burning Pressure (psi) | | | |
| | Sample | 500 | 1000 | 1500 | 1900 |
| Un-Oriented* Casting Powder | (1) | 1.33 | 1.90 | 2.34 | 2.58 |
| Oriented* Casting Powder | (1) | 1.99 | 2.64 | 3.42 | 3.76 |
| | (2) | 1.97 | 3.06 | 3.58 | 4.00 |

*Formulation E, Table I.

The following example illustrates increased loading densities of vertically oriented casting powder granules as compared to randomly oriented granules.

EXAMPLE 5

Casting powder granules, formulation E, Table I, are vertically oriented in the vertical orientation apparatus heretofore described. The test apparatus is energized with three 12-volt direct current batteries connected in series. The loading densities of vertically oriented casting powders are between about 8% to about 10% higher than for randomly loaded casting powder. Table III summarizes the results of these tests.

Table III

| Sample | Random Density (gm./cc.) | Vertical Orientation Density (gm./cc.) |
|---|---|---|
| A | 1.263 | 1.394 |
| B | 1.261 | 1.348 |
| C | 1.255 | 1.335 |

The following example illustrates use of cobalt powder as the magnetically susceptible material in casting powder granules.

EXAMPLE 6

A casting powder mixture formulation F, Table I, is prepared in which cobalt powder is the magnetically susceptible material incorporated therein. The cobalt powder has a nominal particle size of from about 1.5 microns to about 50 microns. The cobalt is chemically stable with the basic ingredients of double base powder. The casting powder is extruded into granules having a diameter of about 100 mils and a length of about 99 mils. The granules are radially oriented satisfactorily.

In the foregoing examples a rod core is employed to generate the magnetic field for orientation of the casting powder granules. Other apparatus can be used to generate this field. One such apparatus has one pole in the center of the mold to be loaded and the other pole opposite and adjacent to the outside of the mold which is to be loaded. This arrangement of poles minimizes the air path through which magnetic flux lines must pass, thereby making the most efficient use of the magnetic field for orientation of granules.

Vertical orientation of any magnetically susceptible material is achieved by placing the mold to be loaded and cast inside a solenoid winding. The magnetic flux lines generated by current flow through the solenoid are parallel to the axis of the solenoid windings. The torque or force required to turn or rotate a powder granule to the vertical position will be greater than that required to turn or rotate a granule for radial axial alignment. The technique described for orienting casting powder containing magnetic material is limited by current flow in the fixed resistance solenoid, i.e., the greater the current flow per unit length of the solenoid, the greater the applied magnetic field. As the field strength increases, the concentration of magnetically susceptible material required in the casting powder granule to permit orientation decreases.

It is apparent that propellant burning rates can be controlled by variations of the orientation techniques described herein. Some of these variations include partial orientation of granules, orientation of mixtures of granules with or without metallic staple contained therein, orientation of magnetically susceptible casting powder in a mixture of casting powders some of which do not contain magnetically susceptible material, orientation of casting powder granules contained in a slurry propellant charge, and the like.

The term "casting powder granule" as used herein is meant to include propellant granules prepared from single base, double base, and triple base powders generally referred to as smokeless powder; as well as propellant granules prepared from composite type propellant formulations.

What we claim and desire to protect by Letters Patent is:

1. A granule of propellant casting powder having incorporated therein a magnetic material having a magnetic susceptibility of at least about $0.1/4\pi$, said magnetic material being incorporated in said granule of propellant casting powder in an amount sufficient to orient the propellant casting powder granule in the desired direction when said granule of propellant casting powder is subjected to an applied magnetic field.

2. The granule of propellant casting powder of claim 1 wherein the casting powder granule contains metallic staple.

3. The granule of propellant casting powder of claim 1 wherein the magnetic material is employed in the form of powder.

4. The granule of propellant casting powder of claim 1 wherein the magnetic material is employed in the form of wire.

5. The granule of propellant casting powder of claim 1 wherein the magnetic material is employed in the form of staple.

6. The granule of propellant casting powder of claim 2 wherein the metallic staple is comprised of aluminum.

7. The granule of propellant casting powder of claim 2 wherein the magnetic material comprises from about 0.1 to about 10% by weight based on the weight of the casting powder granule.

8. A cast propellant charge prepared from oriented casting powder granules and a casting solvent wherein the casting powder granule has incorporated therein a magnetic material having a magnetic susceptibility of at least about $0.1/4\pi$, in an amount of from about 0.1 to about 10% by weight based on the weight of the casting powder granule, and metallic staple, said casting powder granules being oriented in the desired direction by an applied magnetic field prior to casting with casting solvent.

9. The granule of propellant casting powder of claim 7 wherein the magnetic material is selected from the group consisting of iron, cobalt, nickel, gadolium, terbium, dysprosium, halmium, erbium and the alloys thereof.

10. The granule of propellant casting powder of claim 7 wherein the magnetic material is a ferrite material of the general formula ($MO.Fe_2O_3$) wherein M is one of or a mixture of divalent cations selected from the group consisting of manganese, cobalt, nickel, copper, magnesium, cadmium and the ferrous cation $Fe_2^+$.

11. The method of augmenting the burning rate of cast propellant charges which comprises (a) preparing casting powder granules having incorporated therein a magnetic material and metallic staple, (b) filling a mold with the casting powder granules of step (a) and subjecting the casting powder granules to a magnetic field whereby the casting powder granules are oriented in the direction desired, (c) filling the mold containing the oriented casting powder granules with a casting solvent, and (d) curing the cast propellant to form a solid propellant charge having an augmented burning rate.

* * * * *